US006233883B1

(12) United States Patent
Artéon

(10) Patent No.: US 6,233,883 B1
(45) **Date of Patent: *May 22, 2001**

(54) ANCHOR, IN PARTICULAR FOR A CONCRETE PANEL

(76) Inventor: Marcel Artéon, 16 Rue Cino del Duca, FR-92,200 Neailly-sur-Service (FR)

( * ) Notice: Subject to any disclaimer, the term of this patent is extended or adjusted under 35 U.S.C. 154(b) by 0 days.

This patent is subject to a terminal disclaimer.

(21) Appl. No.: 07/659,412

(22) Filed: May 13, 1991

Related U.S. Application Data

(63) Continuation of application No. PCT/FR90/00529, filed on Jul. 13, 1990.

(30) Foreign Application Priority Data

Jul. 17, 1989 (FR) ..... 89 08767

(51) Int. Cl.[7] ..... E02D 35/00; E04C 5/12; E04G 21/14; B66C 1/66

(52) U.S. Cl. ..... 52/125.4; 52/125.2; 52/707; 294/89

(58) Field of Search ..... 52/124.2, 125.1–125.5, 52/707; 294/89

(56) References Cited

U.S. PATENT DOCUMENTS

| | | | | |
|---|---|---|---|---|
| 1,975,235 | * | 10/1934 | Lowell | 52/125.5 |
| 2,886,370 | * | 5/1959 | Liebert | 52/125.4 X |
| 3,861,106 | * | 1/1975 | Erhart | 52/125.4 X |
| 4,087,947 | * | 5/1978 | Turner | 52/125.4 |
| 4,173,856 | * | 11/1979 | Fricker | 52/125.5 |
| 4,702,045 | * | 10/1987 | Fricker | 52/125.4 |
| 4,703,595 | * | 11/1987 | Zipf et al. | 52/125.4 |
| 4,769,960 | * | 9/1988 | Zipf et al. | 52/125.4 |
| 5,469,675 | * | 11/1995 | Arteon | 52/125.5 |

FOREIGN PATENT DOCUMENTS

| | | | | |
|---|---|---|---|---|
| 1800807 | * | 9/1970 | (DE) | 52/125.4 |
| 3329373 | * | 2/1985 | (DE) | 52/125.5 |

* cited by examiner

*Primary Examiner*—Robert Canfield
(74) *Attorney, Agent, or Firm*—Thomas A. O'Rourke; Wyatt, Gerber & O'Rourke

(57) ABSTRACT

The anchor rod (2) has a lateral bulge or projection (5) running along its length and constituting an anchoring element for providing anchoring in a direction perpendicular to the longitudinal direction of the rod (2). Such an anchor is applicable to lifting and handling panels, in particular panels made of reinforced concrete.

5 Claims, 4 Drawing Sheets

ANCHOR, IN PARTICULAR FOR A CONCRETE PANEL

Figure 1:
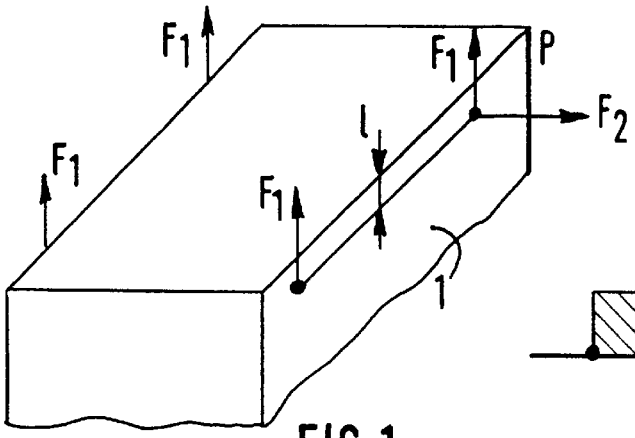

This application is a continuation of PCT/FR90/00529 filed July 13, 1990.

The present invention relates to an anchor for settable materials, and in particular for concrete, the anchor being inserted in a mold before the material is cast, and being particularly, but not exclusively, intended for use in handling thin panels of reinforced concrete such as those which are used in making prefabricated buildings.

Such anchors are well known, with one of the two ends of a rod serving to provide a mechanical connection with the hook of hoisting gear while the remainder of the anchor comprising a longitudinal portion called the "rod" and an opposite end portion called the "foot" is embedded in the settable material when cast.

A first known type of anchor comprises one end which is generally cylindrical in shape with a generally cylindrical rod extending therefrom, the rod being terminated by a foot of greater diameter than the rod. When a traction force is exerted on this insert, the foot of the anchor applies a compression force to the concrete located thereabove. In other words the traction force is applied to the foot and the shape of the foot determines a breakage or pull-out cone.

It is also known to provide an eye in the vicinity of the foot to allow a reinforcing iron or bar to pass through the anchor. This disposition connects the anchor to a reinforcing iron or bar that passes through the eye at the foot of the anchor. In this case, a traction force is applied to the mass of the panel by virtue of the adherence of the reinforcement inside the panel.

Other anchors are also known and used, and in particular so called "fishtail" anchors where the flat rod is terminated by two diverging portions for retaining the anchor in the concrete. The plate-shaped rod is terminated at its top end by a hole for receiving a hook of hoisting apparatus, or else by a threaded rod or by a tapped hole.

Known anchors make it possible to hoist panels under acceptable conditions so long as the lifting forces are exerted in the longitudinal direction of the anchor. However, when the force applied to the panel is no longer in this direction, it may happen that the anchor bends, thereby damaging the not yet completely set concrete if the thickness of the concrete above the anchor is insufficient. In such cases it is therefore necessary firstly to reinforce the bending strength of the anchor and secondly to reinforce the concrete part around the anchor so as to enable it to withstand lateral forces, which forces occur, for example, when the panel as cast in a horizontal position needs raising to the vertical position for drying purposes.

The object of the present invention is to remedy this drawback and to propose an anchor enabling lateral forces to be applied to the panel. The present invention may be applied to all known types of anchor: having a solid or a hollow cylindrical rod, or a flat rod, and having any type of head and any type of foot. In general, the invention serves to increase the traction strength of anchors by obtaining a better distribution of forces in a larger mass of concrete, thereby eliminating local overloading.

According to the present invention, the anchor comprising a head, a longitudinal rod, and an anchor foot, is characterized in that at least one lateral anchoring element is fixed to the rod.

Whereas in known anchor pieces, the anchor is designed to withstand the application of a unidirectional force exerted in the longitudinal direction of the anchor, the anchor of the invention presents much higher strength in a transverse direction perpendicular to the longitudinal direction of the anchor.

In general, the lateral anchoring element constitutes a projection from the rod making it possible, optionally, to offset the contact points of reinforcing irons away from the midplane of the panel, i.e. away from the longitudinal direction of the anchor, should it be desirable to make a connection with the irons.

Figure 1A:
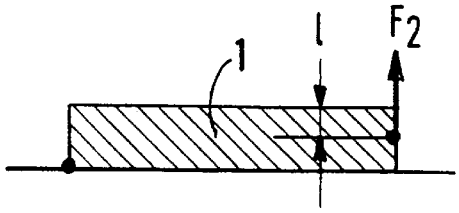
Figure 2:
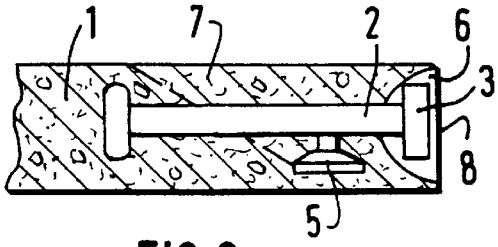
Figure 3:
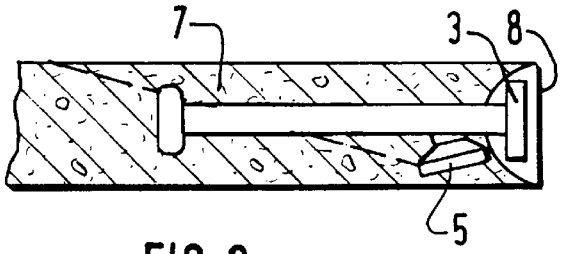
Figure 2A:
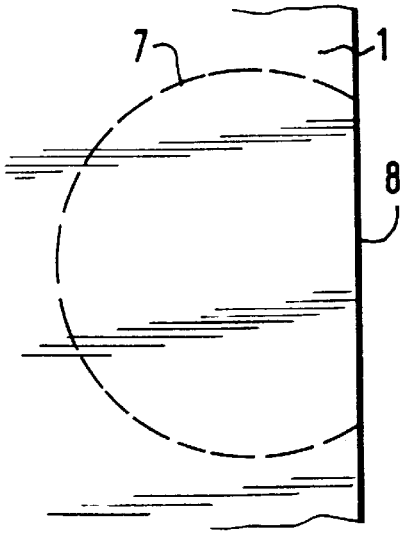
Figure 3A:
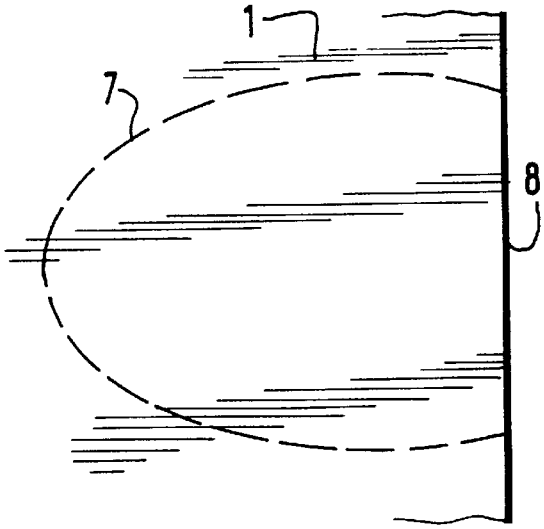
Figure 4:
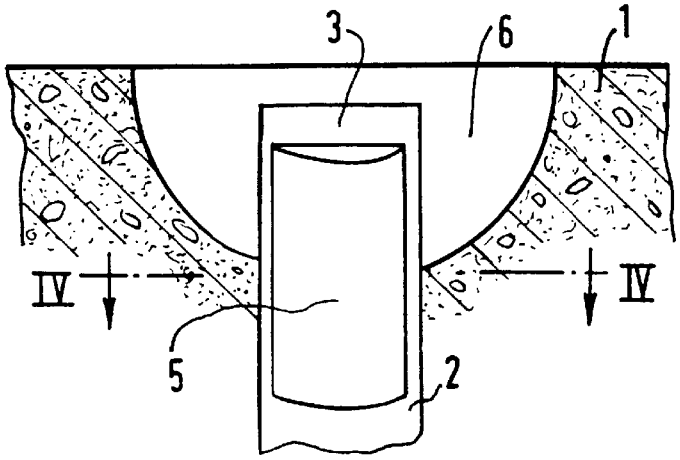
Figure 4A:
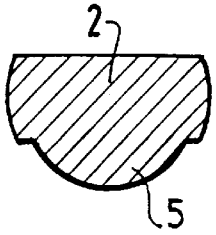
Figure 5A:
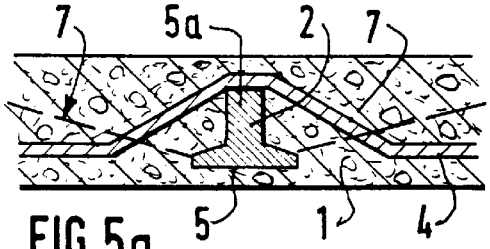
Figure 5:
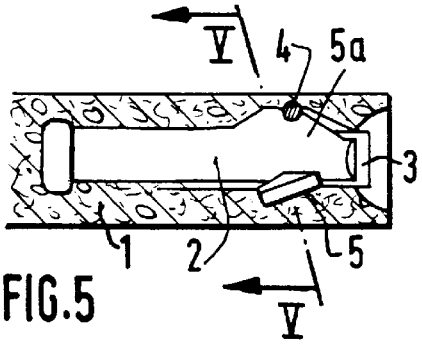
Figure 6:
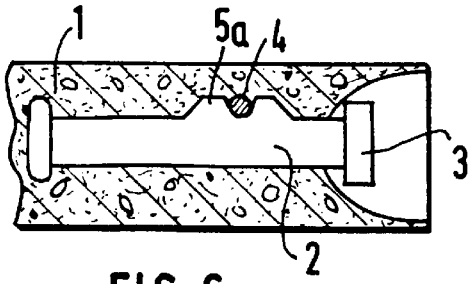
Figure 6A:
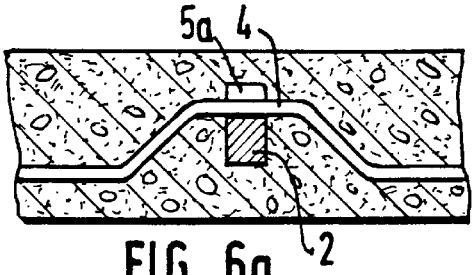
Figure 7:
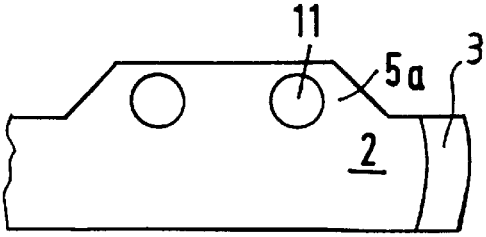
Figure 8:
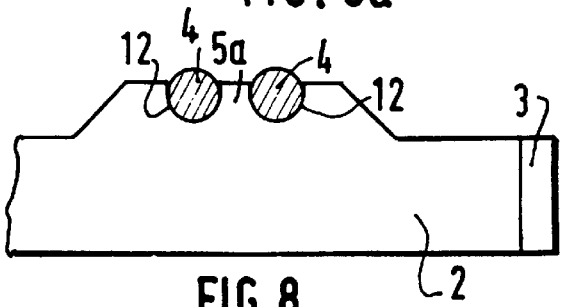
Figure 9:
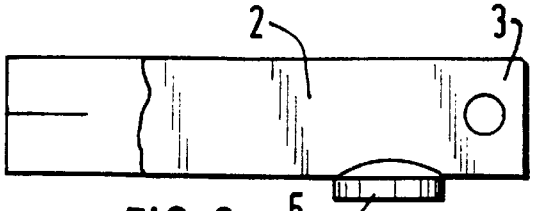
Figure 9A:
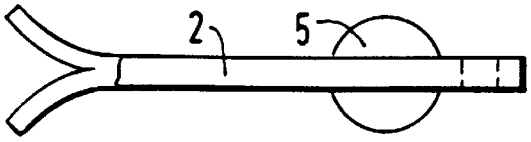
Figure 11:
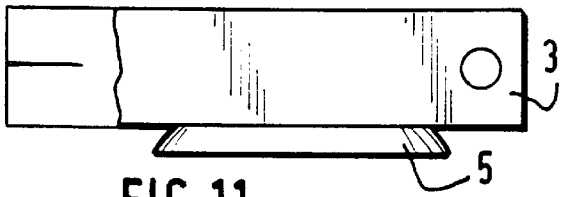
Figure 11A:
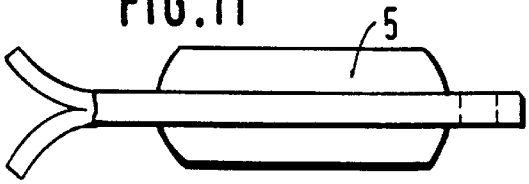
Figure 10:
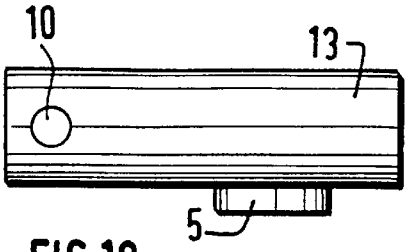
Figure 10A:
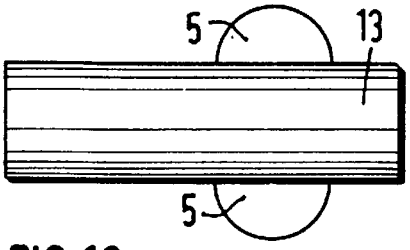
Figure 10B:
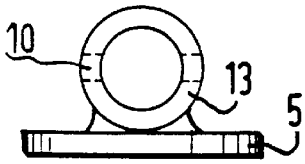
Figure 12:
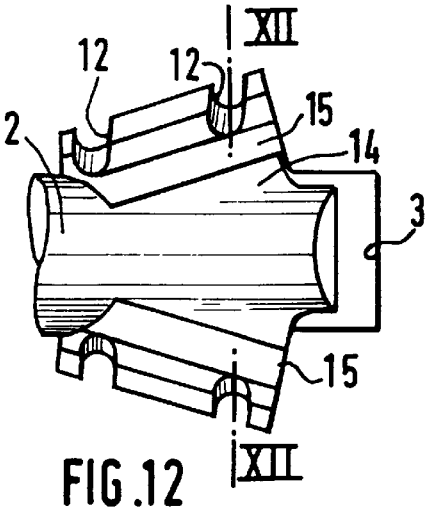
Figure 12A:
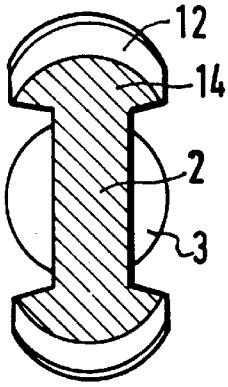
Figure 13:
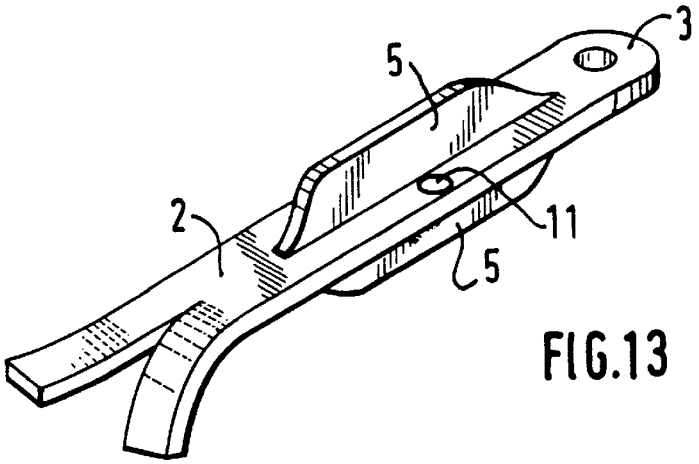
Figure 14:
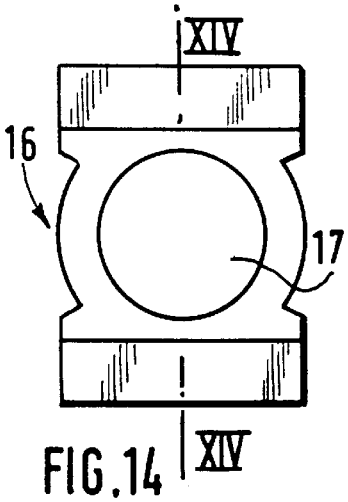
Figure 14A:
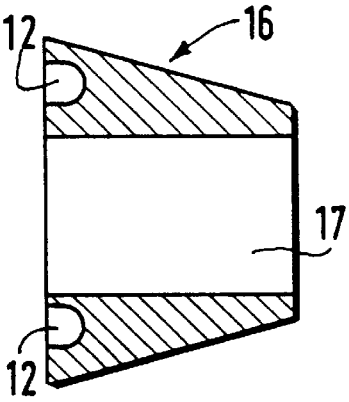
Figure 14B:
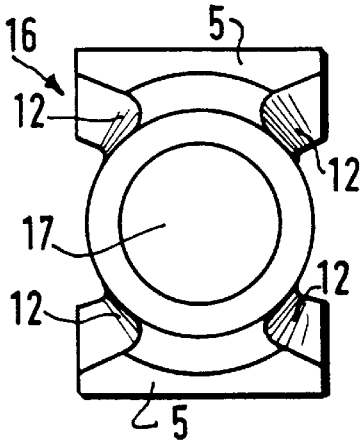
Figure 15A:
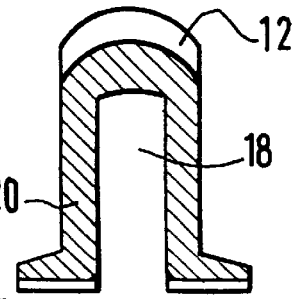
Figure 15:
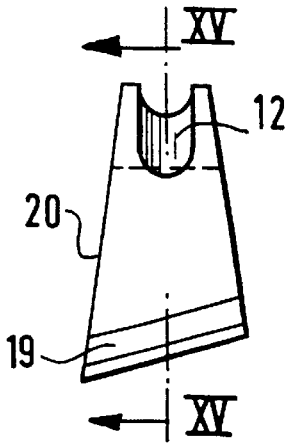

Other characteristics and advantages of the invention appear from the following description of particular embodiments given purely by way of non-limiting example and described with reference to the accompanying figures, in which:

FIGS. 1 and 1*a* are diagrams for explaining the problem which is solved by the invention;

FIGS. 2 and 2*a* are diagrams for explaining a first embodiment, with FIG. 2 being a vertical section and FIG. 2*a* being a plan view showing the limits of the anchoring cone;

FIGS. 3 and 3*a* are similar diagrams applicable to a variant embodiment;

FIGS. 4 and 4*a* are respectively a vertical section and a horizontal section on line IV—IV of FIG. 4;

FIGS. 5 and 5*a* are a vertical section and a section on line VI—VI of FIG. 5;

FIGS. 6 and 6*a* are a vertical section and a cross-section through an anchor;

FIGS. 7 and 8 show variants of the embodiment of the anchor shown in FIG. 6;

FIGS. 9 and 9*a* show a flat rod anchor with a hole in accordance with the invention;

FIGS. 10, 10*a*, and 10*b* show an embodiment of an anchor having a sleeve;

FIGS. 11 and 11*a* show an embodiment of a flat anchor having an elongate lateral anchoring foot;

FIGS. 12 and 12*a* show a cylindrical rod anchor having a symmetrical lateral anchoring element, FIG. 12*a* being a section on line XII—XII of FIG. 12;

FIG. 13 shows another embodiment of a flat anchor;

FIGS. 14 to 14*b* are a front view of a lateral anchoring piece for attaching to an anchor having a sleeve or a cylindrical rod; and FIGS. 15 and 15*a* are two views of an anchoring element for fixing to a flat anchor.

As mentioned above, there are numerous cases where anchors are required to withstand forces that are not longitudinal. A first example is shown in FIG. 1 which shows a thick panel for which the user requires that there be no anchor points in the top face. In such a case, hoisting must be performed from lateral anchor points. The forces F1 applied to the anchors are therefore perpendicular to the direction in which the anchors extend (not shown). If the thickness 1 is insufficient, then the anchors will deform and damage the concrete. Another example where the invention is applicable is shown in FIG. 1*a*. In this case, a thin panel is to be lifted, i.e. it is to be raised from the horizontal position as shown to the vertical position by being pivoted through 90° by applying a force F2 to its anchors. Hereagain, if the thickness 1 of the concrete above the anchor is insufficient, then the anchor will deform and damage the concrete. Panels are also subject to lateral forces when they are subjected to wind effects while they are suspended from hoisting apparatus. The present invention serves to reinforce anchors and the handling of panels, even when the thickness 1 is insufficient for conventional anchors. To do this, the strength of each anchor in the plane P of FIG. 1 containing the forces F1 or F2 is increased regardless of the angle that may exist between the longitudinal direction of the anchor and the direction of the external force.

A first embodiment of the invention is shown in FIGS. 2 and 2*a*. In this example, the anchor has a cylindrical head 3 and a cylindrical rod 2, with any type of anchor foot (not shown) being suitable. In accordance with the invention, a lateral anchoring element 5 is disposed parallel to the rod 2 of the anchor. The lateral anchoring element defines a pull-out cone 7 whose limits are shown in dashed lines. The periphery of the cone 7 can be seen more clearly in FIG. 2*a*. It is circular in shape. The lateral an anchoring element 5 is preferably disposed as close as possible to the head 3.

Unfortunately, given that the lateral anchoring element 5 is close to the head 3, the breakage cone is intersected by the line 8 (as shown in FIG. 2*a*) constituting the edge of the panel, such that the strength of the cone (which is proportional to the volume of the cone) is correspondingly reduced. Thus, according to a characteristic of the invention, the anchoring element 5 may have an axis of symmetry which slopes relative to the panel as shown in FIG. 3*a,* the periphery of the cone 7 takes up an elliptical shape. Its volume is much larger, and consequently the strength it provides is much larger.

In the examples shown above, the lateral anchoring element is constituted by a cylindro-conical part. It is also possible, for the purpose of increasing the stiffness of a cylindrical rod, to provide a projection 5*a* thereon such as that shown in FIG. 4 which is a vertical section through the top end of an anchor having a head 3 and a rod 2, both of which are generally cylindrical in shape. As can be seen in FIG. 4*a,* the thickness of the rod 2 is increased in the direction in which the ring of hoisting apparatus (not shown) is engaged in the recess 6, while remaining constant in a direction perpendicular thereto. The stiffness of the rod 2 is increased in this way and it is possible to tilt panels up from the horizontal position to the vertical position in which the anchor operates normally. The stiffness of the anchor rod is thus increased transversely without there being a significant reduction in the thickness of the concrete.

FIGS. 5 and 5*a* show an anchor having a cylindrical rod 2 and a cylindrical head 3 with a projection 5*a,* and a lateral anchoring element 5 on the opposite side of the rod therefrom. A reinforcing iron 4 bears against the projection 5*a* as described below and the lateral anchoring element 5 defines a pull-out cone 7. An anchor as shown in FIGS. 5 and 5*a* may operate simultaneously in compression via the lateral anchoring element piece-5 and in adherence via an iron 4 passing over the projection or swelling 5*a*.

FIGS. 6, 6*a,* 7, and 8 show another embodiment with an anchor having a flat or a cylindrical rod 2, a cylindrical head 3, and a longitudinal projection 5*a*. This projection may receive reinforcing irons 4, either passing through one or more holes 11 provided in the projection 5*a* (FIG. 7), or else in notches 12 formed in said projection 5*a* (FIG. 8).

FIGS. 9 and 9*a* show an anchor having a flat rod 2 in front view and in top view, with the anchor head 3 having an orifice for receiving a hoisting ring. Laterally to the longitudinal direction of the plate 2 there extends a disk-shaped shaped cylindrical anchoring piece 5 which is either fixed to the rod or is integrally formed therewith. As before, this piece operates in compression and the end of the rod 2 (not shown) may be of any appropriate shape, e.g. a fishtail shape.

FIGS. 10, 10*a,* and 10*b* show an anchor having a tapped sleeve 13 with lateral anchoring elements 5. Handling means (not shown) may be engaged inside the anchor by being screwed thereto. As can be seen in FIG. 10*a,* lateral anchoring elements 5 project on either side of the sleeve 13. They may be fixed at any point along the length of the sleeve.

FIGS. 11 and 11*a* show a flat anchor whose lateral anchoring element 5 extends over substantially the entire length of the anchor. This makes it possible to handle panels in which the anchor is included in a direction perpendicular to the longitudinal direction of the anchor.

In the examples given above, the lateral anchoring elements are integrated with the anchor when the anchor is manufactured. That is to say the anchor is capable of operating in the longitudinal direction like a conventional anchor, and also in directions perpendicular thereto.

However, the anchors and their lateral anchoring elements must necessarily be properly positioned inside the mold in order to be capable of withstanding lateral forces. In order to avoid positioning errors in the mold, it is also possible to provide lateral anchoring elements which are symmetrical in structure, such as those shown in FIGS. 12 and 13.

In FIGS. 12 and 12*a,* the rod 2 has lateral projections 14 with two pieces 15 being formed thereon, each piece 15 having grooves 12 for passing reinforcing irons. Such a piece can be obtained directly by forging. In the example shown, the head 3 is cylindrical, but it could be flat or constituted by a tapped sleeve.

FIG. 13 is a perspective view of a flat rod anchor having lateral anchoring elements 5 projecting on either side of the rod from both faces thereof, said elements extending over a major portion of the length of the rod 2. The elements 5 project from the rod substantially in the midplane thereof whereas in the preceding examples, the anchoring elements extend from one of the edges of the anchor. Orifices 11 are advantageously provided passing perpendicularly through the rod. When required, reinforcing irons may be inserted through the orifices 11. Such an anchor, like the anchor shown in FIG. 12, has the advantage of enabling panels to be handled in two opposite directions relative to the longitudinal direction of the anchor, and in particular they enable the panel to be turned over completely.

In the examples given above, the anchors are constituted by single blocks. It is also possible to implement the invention by add-on pieces which may be fixed to conventional anchors by friction, by welding, by brazing, etc.

The piece 16 shown in FIGS. 14, 14*a,* and 14*b* is more particularly designed to be threaded over a sleeve anchor. It has a central orifice 17 for sliding over the rod of an anchor, and grooves 12 for retaining reinforcing irons. Lateral anchoring elements, enable such an anchor to be used in compression, i.e. without being connected to reinforcing bars.

FIGS. 15 and 15*a* show a piece 20 suitable for applying to a flat rod anchor and capable of being fixed thereto by any appropriate means. It is in the form of a U-shape or staple whose opening 18 is applied against the sides of the rod. Feet 19 on the piece 20 are preferably inclined relative to the horizontal as in the embodiment of FIG. 3 in order to increase the volume of the breakage cone. At the top of the piece 20 there is a groove 12 for receiving a reinforcing bar (not shown).

Naturally, numerous variants may be envisaged, in articular by substituting technically equivalent means, without thereby going beyond the scope of the invention.

What is claimed is:

1. An anchor for reinforced concrete panels comprising a head end suitable for cooperation with hoisting equipment, a rod extending in a longitudinal direction from said head end and a foot end on the rod remote from said head end, said foot end adapted to provide a longitudinal anchoring of the anchor in said concrete, wherein at least a lateral projection forming a lateral anchoring element is provided on at least one portion of the rod, a dimension of said lateral anchoring element being greater in size in at least one direction than the size of said rod, said lateral anchoring element projecting substantially perpendicular to the longitudinal direction of the rod and being constituted by a disk parallel to the longitudinal direction of the rod.

2. An anchor for reinforced concrete panels comprising a head end suitable for cooperation with hoisting equipment, a rod extending in a longitudinal direction from said head end and a foot end on the rod remote from said head end said foot end adapted to provide a longitudinal anchoring of the anchor in said concrete, wherein at least a lateral projection forming a lateral anchoring element is provided on at least one portion of the rod a dimension of said lateral anchoring element being greater in size in at least one direction than the size of said rod and wherein the anchoring element extends over substantially the entire length of the rod.

3. An anchor according to claim 2 wherein two lateral anchoring elements extend on either side of the rod.

4. An anchor for reinforced concrete panels comprising a head end suitable for cooperation with hoisting equipment, a rod extending in a longitudinal direction from said head end and a foot end on the rod remote from said head end, said foot end adapted to provide a longitudinal anchoring of the anchor in said concrete, wherein at least a lateral projection forming a lateral anchoring element is provided on at least one portion of the rod away from said foot end, a dimension of said lateral anchoring element being greater in size in at least one direction than the size of said rod and wherein said lateral anchoring element is provided only on one side of said rod.

5. An anchor for reinforced concrete panels comprising a head end suitable for cooperation with hoisting equipment, a rod extending in a longitudinal direction from said head end and a foot end on the rod remote from said head end, said foot end adapted to provide a longitudinal anchoring of the anchor in said concrete wherein at least a lateral projection forming a lateral anchoring element is provided on at least one portion of the rod away from the foot end, a dimension of said lateral anchoring element being greater in size in at least one direction than the size of the rod and wherein said lateral anchoring element has at least one hole for receiving a reinforcing iron.

* * * * *